United States Patent [19]

Torres

[11] Patent Number: 4,706,905

[45] Date of Patent: Nov. 17, 1987

[54] REEL STAND

[76] Inventor: Manuel Torres, Sancho el Fuerte, 21, 31007 Pamplona, Spain

[21] Appl. No.: 891,875

[22] Filed: Jul. 30, 1986

[30] Foreign Application Priority Data

Sep. 10, 1985 [ES] Spain ..... 546831

[51] Int. Cl.[4] ..... B65H 19/12

[52] U.S. Cl. ..... 242/68.4; 242/58.6; 242/129.51

[58] Field of Search ..... 242/55.2, 58.6, 64, 242/68, 68.4, 71.8, 72 R, 73, 86.5, 129.5, 129.51

[56] References Cited

U.S. PATENT DOCUMENTS

| | | | |
|---|---|---|---|
| 3,052,422 | 9/1962 | Moser et al. | 242/68.4 |
| 3,057,571 | 10/1962 | Aaron et al. | 242/68.4 X |
| 3,075,719 | 1/1963 | Hornstein et al. | 242/68.4 X |
| 3,743,198 | 7/1973 | Lucas | 242/58.6 |
| 4,098,468 | 7/1978 | Skalleberg | 242/68.4 X |
| 4,200,245 | 4/1980 | Bugnone | 242/64 |
| 4,460,135 | 7/1984 | Hirakowa | 242/68.4 |

*Primary Examiner*—Donald Watkins
*Attorney, Agent, or Firm*—Lucas & Just

[57] ABSTRACT

A reel stand of the kind having a pair of arms (1) capable of horizontal movement towards and away from one another and pivotal movement in a vertical plane, characterized in that the arms (1) are vertically movable in translation, the conjunction of which vertical translational movement with the pivotal movement enables cones (10) on the arms (1) to reach positions of alignment with the support shafts of paper reels of different diameters.

7 Claims, 10 Drawing Figures

REEL STAND

DESCRIPTION

The invention relates to reel stands, the function of which is to pick up reels of paper, generally from transporting means, and to lift them and place them in an unreeling or working station and also the reverse function, namely, to put the reels down on said transporting means once the reels have been used up or as otherwise required.

Such reel stands incorporate pairs of arms which are designed to pick up the reels between them, for which purpose the arms have at their ends support cones which locate in the ends of a hollow support shaft on which the reels are mounted.

In known reel stands each pair of arms can only carry out two movements, the first of which is in a horizontal plane for mutual approach or separation, in order to move them into or move out of engagement with the support shaft of the reel and the other of which is a turning movement in order to lift the reel, once grasped, into the working position or to lower and deposit the reel when it had been exhausted or when it has to be replaced.

Since the reels to be used may have different diameters, their shafts will be at different heights relative to the ground. As a result of this and since the arms of the known reel stands only describe two movements, the horizontal one of mutual approach or separation which has to take place when the support cones are already facing one another or aligned with the hollow shaft, and the turning movement which has to be the one that brings the support cones into alignment with said hollow shaft, said alignment is not achieved in the majority of occasions since a circumferential arc which always has the same radius cannot always coincide with different shaft heights.

To overcome this problem the support cones are positioned as close as possible to the hollow shaft of the reel and then the latter has to be moved into alignment which, because of its dimensions and weight, is a complex, slow and very difficult job. This problem is aggravated by the fact that, in addition to the difficulties involved in the operation, it is impossible to automate the process of loading and unloading the reels completely so that this stage of the process is an impediment to complete automation.

The object of the present invention is to solve or mitigage this problem by arranging for the arms additionally to be movable in a vertical plane.

The combination of the vertical and turning movements of the arms of the reel stand enables their support cones to take up any required position within an area which is always sufficient to bring about their alignment with the longitudinal axis of the hollow shaft of the reels.

According to one preferred embodiment, since the hollow shaft of the reels will be positioned at a height which may differ as a function of the diameter of the same, but always lies in the same vertical plane, in order to pick up a reel, the arms of the reel stand will describe a downward turning movement until they reach the lowest possible position within said vertical plane in order to pick up or put down the reel with the smallest diameter. Once they are in this position and by virtue of the third movement in a vertical plane, said arms will rise until the support cones meet with the hollow shaft of the reel, and will then engage it and establish the necessary coupling.

Preferably the different rectilinear movements of the two pairs of arms of a reel stand in the horizontal and vertical planes are achieved with a single motor drive.

The invention is diagrammatically illustrated, by way of example, in the accompanying drawings, in which.

EXPLANATORY DETAILS

Figure 2:
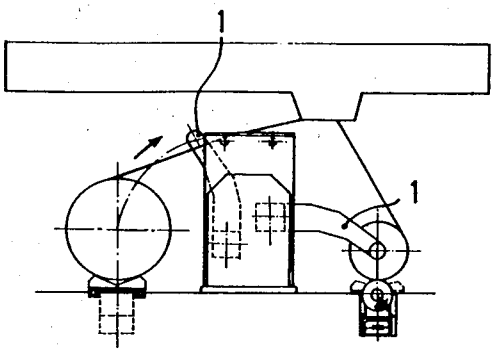
FIG. 2 is a side view elevation of a reel stand, showing the turning movement of the arms.

1. Arms
2. Main support shaft
3. Columns
4. Motor
5. Distribution box
6. Drive shaft
7. Drive shaft
8. Reversing box
9. Support housing
10. Reel support cones
11. Central distribution shaft
12. Clutches
13. Lifting screw
14. Intermediate shaft
15. Drive
16. Transverse screw
17. Brake
18. Crown wheel
19. Rack
20. Cylinder
21. Mechanism for slow precise movements
22. Initial portion of the arms (1)

Figure 1:
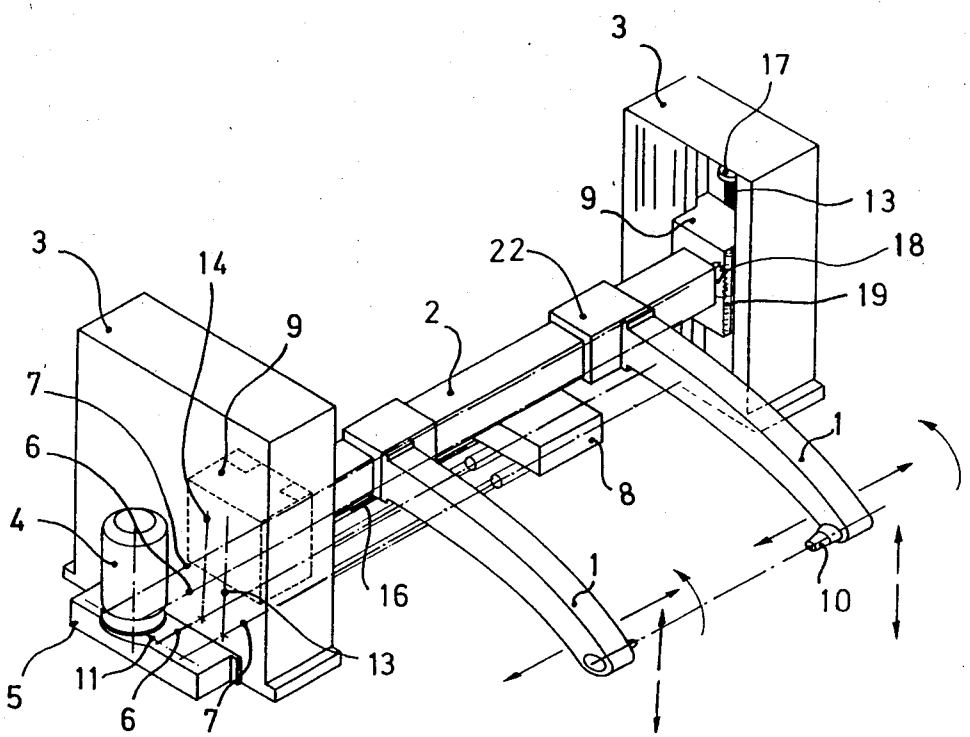
FIG. 1 is a perspective view of a reel stand.

A stand for reels of paper is shown in the drawings. As can be seen in diagrammatic form in FIG. 1 in a view which shows a pair of arms (1) on only one side of the reel stand, these arms (1) which pick up the reel from its corresponding means of transport are fitted by means of their initial portion (22) on a main support shaft (2) each end of which is connected to a support housing (9) each of which can move in a vertical direction in a pair of columns (3). In accordance with the present invention, the arms (1) and their support cones (10) which extend into the hollow shaft or spindle of the reels can be provided with the following movements:

1. Vertical displacement of the arms (1) in an upward or downward direction, see FIG. 3.

2. Oscillation of the arms (1) turning with the main support shaft (2) and following the path of an arc, see FIG. 2.

3. Approach and separation of the arms (1) including joint and synchronised movement of the arms (1) to one or other side, see FIG. 1.

Figure 3:
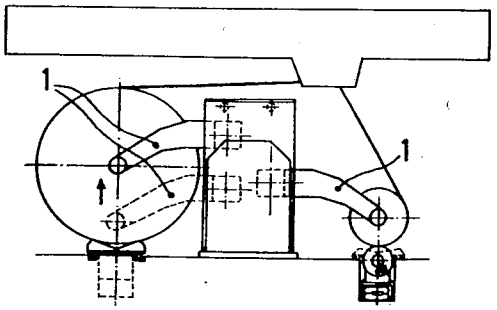
FIG. 3 is a side elevation of the reel stand as in FIG. 2 and showing the vertical movement of the arms.

Thus, for example, as shown in FIGS. 2 and 3, in order to allow the entry of a new reel, the arms (1) may move to an upper position after which the arms (1) and the main shaft (2) turn in a downward direction so that the support cones (10) take up the lowest position on the vertical line through the centre of the means transporting the reels. This makes it possible to pick up reels of smaller diameters. From the lowest position, the pair of arms (1) moves upward vertically until sensors detect the central hollow shaft of the reel and, at this moment, the arms (1) approach, moving the cones (10) inwards and taking hold of the reel which is then raised to the working position by means of the upward turning movement of the arms (1).

Preferably the rectilinear movements in both horizontal and vertical directions of all of these movements are powered by a single motor (4) and a series of mechanical devices producing synchronisation. Obviously, the motor (4) could be replaced by a number of motors. Through a distribution box the motor (4) drives two pairs of drive shafts (6 and 7) which respectively move each pair of arms (1) on the two sides of the machine.

In each pair of drive shafts (6 and 7), the shaft (6) drives the mechanism for approach or separation of the arms (1) while the shaft (7) controls the raising or lowering.

The drive shaft (6) is connected to a reversing box (8) which, by means of a set of gears, enables both arms (1) to be moved simultaneously and to one side or another so that the area of wear of the components of the machine is spread.

Figure 4:
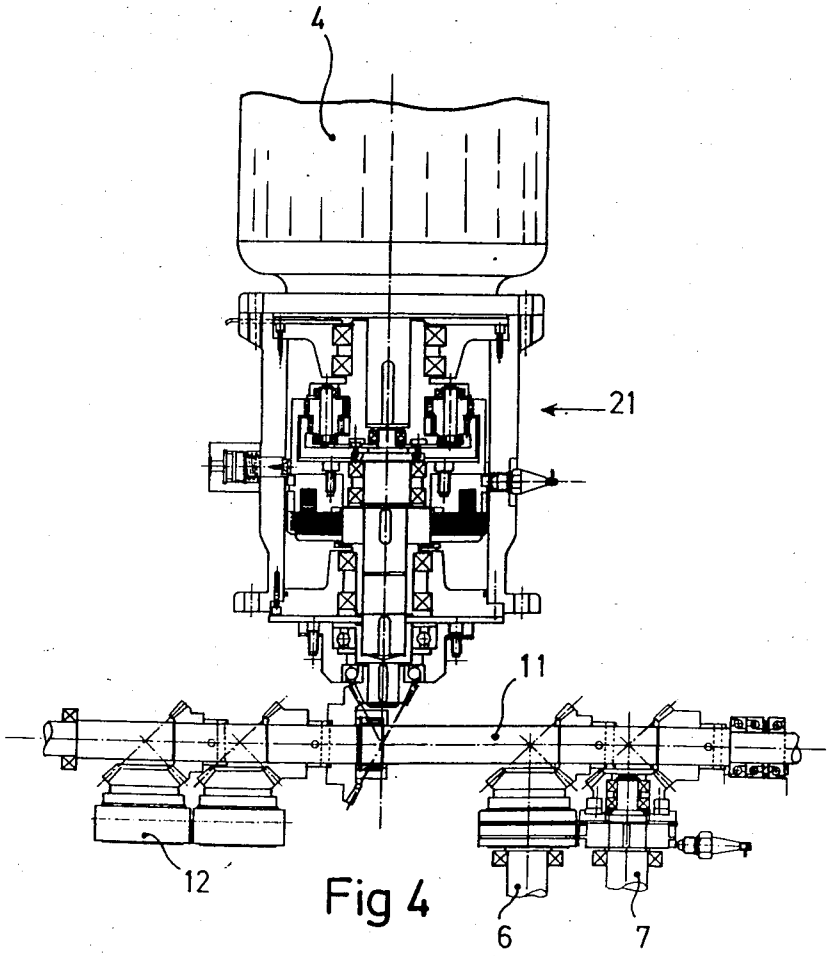
FIG. 4 is a section of a motor which drives the mechanism of the reel stand and its central power distribution shaft.

As can be seen in FIG. 4, the motor (4) acts through a mechanism (21) provided optionally to achieve slow precise movements, driving a central distribution shaft (11) in the box (5). On either side of the motor (4) there are symmetrical bevel gears which act on the two pairs of shaft (6) and (7), with clutches (12) between the corresponding gear and said shafts which are only actuated by the corresponding automatic system when it is necessary to describe a movement.

Figure 6:
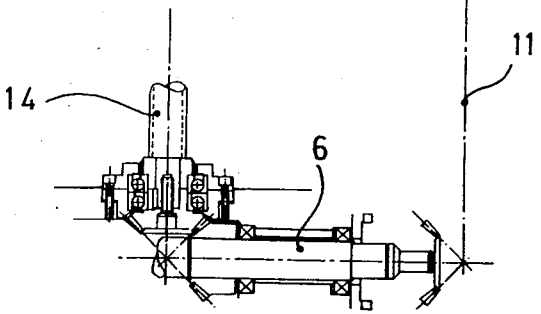
FIG. 6 shows in profile a partial section of a coupling between a drive shaft (6) and an opening and closing drive.
Figure 8:
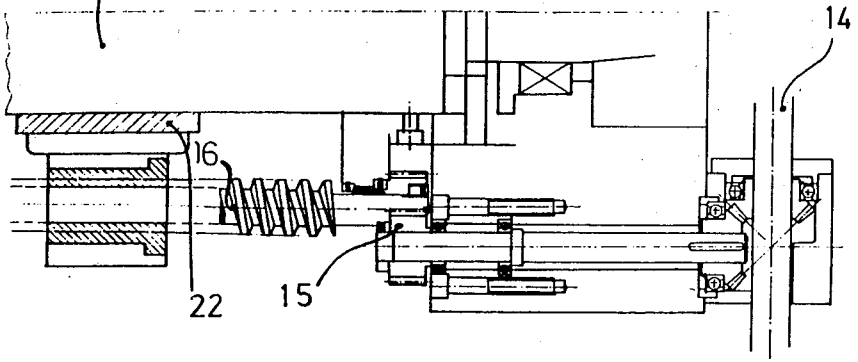
FIG. 8 shows the opening and closing drive in profile.
Figure 9:
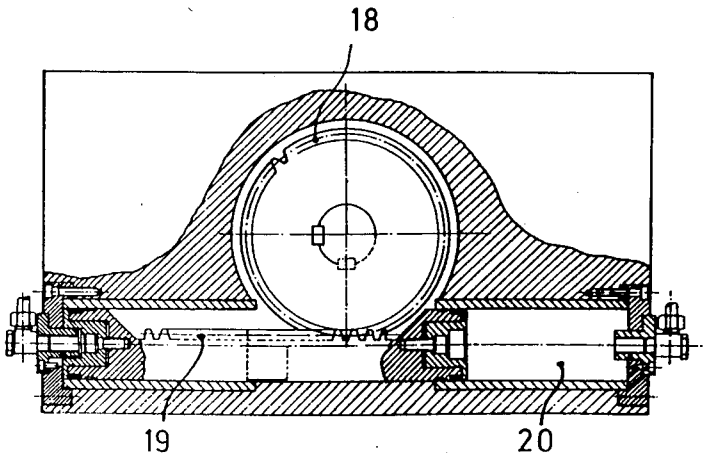
FIG. 9 is a sectional elevation of an arm turning drive.

In each column (3)—see FIG. 6—the transverse shaft (6) acts through a bevel gear drive on an intermediate shaft (14) which is disposed vertically and has longitudinal grooving or a similar solution which allows movement of a bevel gear, see FIG. 8. This bevel gear in turn acts via a horizontal shaft with a drive (15) on a transverse screw with ball bearings (16), producing the corresponding horizontal approach or separation movement of the arms (1).

Figure 5:
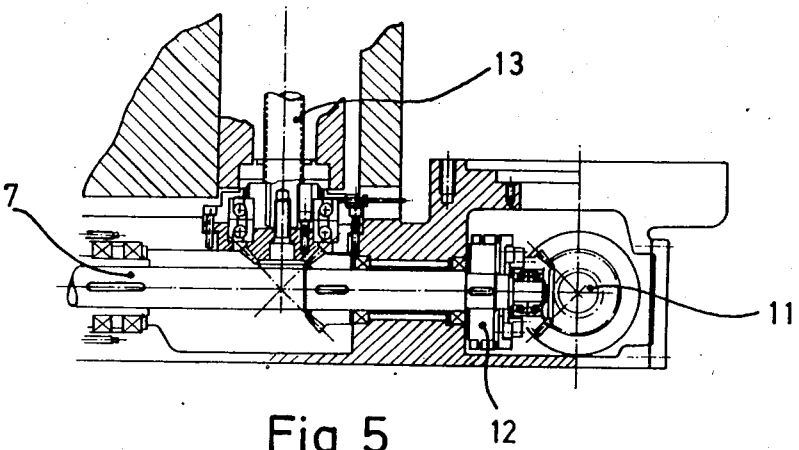
FIG. 5 shows in profile a partial section of the reel stand showing a drive shaft (7) and the coupling to a lifting screw (13)
Figure 7:
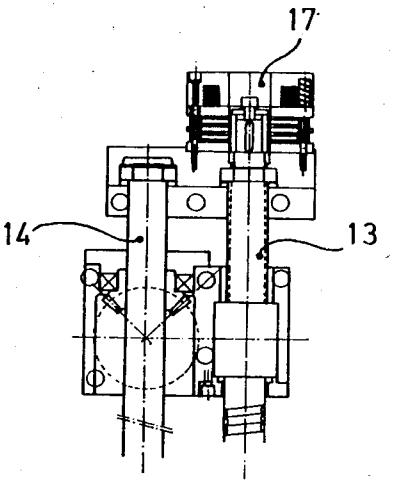
FIG. 7 shows a lifting screw (13) in profile.

On the other hand, each transverse shaft (7)—see FIG. 5—acts through a pair of bevel gear assemblies to drive a pair of lifting screws (13) which, being located in the end support housings (9), raise or lower the arm assembly (1). As can be seen in FIG. 7, in its upper part each screw (13) has a brake (17) which prevents any undesired movement of the assembly as a result of the weight of the reels when the arms (1) are in the raised position.

In each support housing (9) there is a crown wheel (18) which is integral with the main support shaft (2) of the arms (1); said crown wheel (18) engages with a rack (19) which is the rod of a double-acting hydraulic cylinder (20). According to this, in order to turn the arms, it is merely necessary to drive fluid under pressure to one or other end of the cylinder (20) which will cause the entire arm (1) and shaft (2) assembly to turn.

Figure 10:
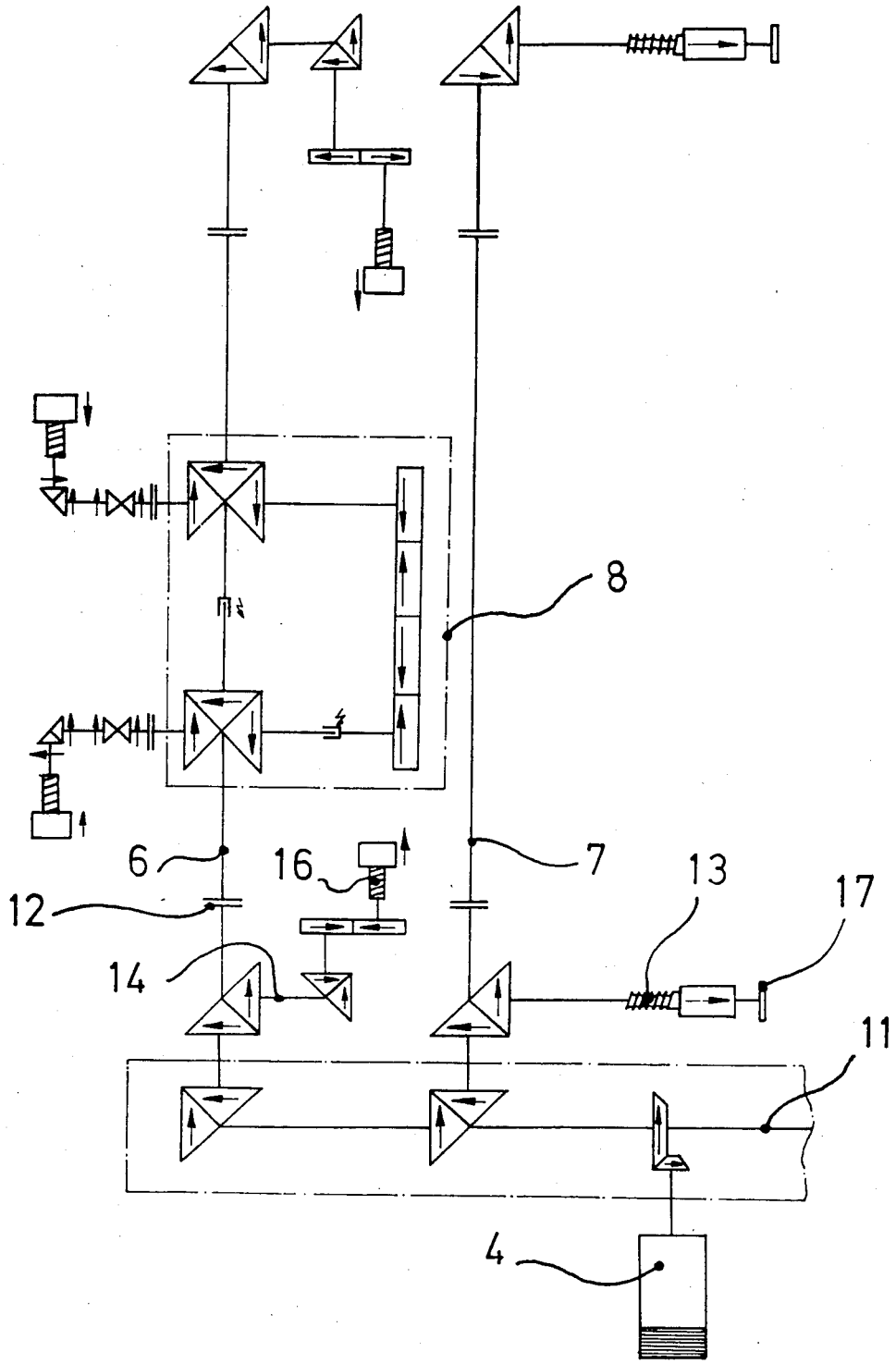
FIG. 10 is a diagram of the chain of movement of the mechanisms driving the arms (1).

The assembly comprising the described mechanisms can be seen in a simplified chain of movement in FIG. 10 which only shows the mechanical drive for one pair of arms since the corresponding drive to the other pair is symmetrical. This chain of movement in FIG. 10 shows how, by means of ther reversing box (8), it is possible for one of the two screws (16) designed for the horizontal movements and capable of rotating in either direction to change its direction of rotation so that the arms (1) can move jointly towards either end of the machine in order to distribute working times and wear in addition to approaching or separating from one another.

FIGS. 2 and 3 show how, in one example of an installation the reels are brought up to the reel holder by transporting trucks which run on rails on which it is possible to dispose optional accelerating mechanisms with a retractable arrangement like those shown operating on the reels of a smaller diameter by tangential contact with the same.

I claim:

1. A reel stand for handling rolls of paper comprising:
(a) two laterally spaced columns;
(b) a main support shaft, horizontally positioned between said two columns, one end of said support shaft movably connected to one of said columns, the other end of said support shaft movably connected to the other column;
(c) two arms, one end of each said arm connected to said support shaft;
(d) roll engagement means mounted at the other end of each said arm for engaging saids rolls of paper; and,
(e) power means for providing said arms and support shaft with three movements,
a first movement for horizontally moving said arms relative to one another towards and away from each other to adjust the space between said roll engagement means, thereby allowing said roll engagement means to engage and disengage said roll,
a second movement for vertically moving said arms and said support shaft relative to a first plane that intercepts both columns, up and down in a second vertical plane which is parallel to said first vertical plane, thereby adjusting the height of said roll engagement means relative to said roll,
a third movement for rotationally moving said arms.

2. The reel stand of claim 1 wherein said power means is a motor.

3. The reel stand of claim 1 further comprising:
(a) a central distribution shaft connected to said power means; and,
(b) a pair of drive shafts connected to said central distribution shaft, one of each said drive shafts connected to one of each said arms and one drive shaft controlling the first movement and the other drive shaft controlling said second movement.

4. The reel stand of claim 3 further comprising a reversing box connected to said drive shaft.

5. A reel stand for handling rolls of paper comprising:
(a) two laterally spaced solumns;

(b) two support means, one of each said support means housed in one of each said columns;

(c) a main support shaft horizontally positioned between said two columns, one end of said support shaft connected to one of said support means and the other end of said support shaft connected to the other support means;

(d) two arms, one end of each said arms connected to said support shaft;

(e) roll engagement means mounted at the other end of each said arm for engaging said rolls of paper;

(f) power means for providing said arms and support shaft with three movements, a first movement for horizontally moving said arms relative to one another towards and away from each other to adjust the space between said roll engagement means, thereby allowing said roll engagement means to engage and disengage said roll, a second movement for vertically moving said arms and said support shaft relative to a first plane that intercepts both columns, up and down in a second vertical plane which is parallel to said first vertical plane, thereby adjusting the height of said roll engagement means relative to said roll, a third movement for rotationally moving said arms, (g) a central distributor shaft connected to said power means;

(h) a pair of drive shafts connected to said central distribution shaft, one of each said drive shafts connected to one of each said arms and one drive shaft controlling the first movement and the other drive shaft controlling said second movement; and, (i) a pair of crown wheels, one of each crown wheels housed in one of each said support means for controlling said third movement.

6. The reel stand of claim 5 wherein said power means is a motor.

7. The reel stand of claim 6 further comprising a reversing box connected to said drive shaft.

* * * * *